US006070540A

United States Patent [19]

Nomura et al.

[11] Patent Number: 6,070,540

[45] Date of Patent: Jun. 6, 2000

[54] HOLING SEWING MACHINE

[75] Inventors: Etsuzo Nomura, Kasugai; Akihiro Funahashi, Handa; Itaru Shibata, Nagoya; Tohru Takemura, Inazawa, all of Japan

[73] Assignee: Brother Kogyo Kabushiki Kaisha, Nagoya, Japan

[21] Appl. No.: 09/197,421

[22] Filed: Nov. 23, 1998

[30] Foreign Application Priority Data

Nov. 26, 1997 [JP] Japan ..... 9-342193

[51] Int. Cl.[7] ..... D05B 3/06; D05B 19/12; D05B 29/02; D05B 65/00; D05B 69/18

[52] U.S. Cl. ..... 112/68; 112/237; 112/291; 112/470.04; 112/470.05

[58] Field of Search ..... 112/65, 66, 67, 112/68, 70, 237, 239, 291, 285, 475.25, 470.01, 470.04, 470.05, 220, 277

[56] References Cited

U.S. PATENT DOCUMENTS 5,080,031 1/1992 Suzuki et al. ..... 112/237 X
5,361,713 11/1994 Suzuki ..... 112/68

*Primary Examiner*—Peter Nerbun

*Attorney, Agent, or Firm*—Oliff & Berridge, PLC

[57] ABSTRACT

A holing sewing machine including a workpiece-presser elevating and lowering mechanism which elevates and lowers a workpiece presser, a needle-thread cutting mechanism which cuts a needle thread conveyed by a sewing needle; a bobbin-thread cutting mechanism which draws a bobbin thread from a bobbin and cuts the bobbin thread, an interlocking mechanism which mechanically interlocks the elevating and lowering mechanism, the needle-thread cutting mechanism, and the bobbin-thread cutting mechanism, with one another, such that the elevating and lowering mechanism elevates the workpiece presser after the needle-thread cutting mechanism cuts the needle thread and the bobbin-thread cutting mechanism cuts the bobbin thread, a drive source which drives the interlocking mechanism to operate the workpiece-presser elevating and lowering mechanism, the needle-thread cutting mechanism, and the bobbin-thread cutting mechanism, the drive source being controllable with respect to a speed of operation thereof to drive the interlocking mechanism, and a control device which controls the drive source such that the drive source is operated at a higher speed at at least one of a time when the needle-thread cutting mechanism cuts the needle thread and a time when the elevating and lowering mechanism elevates the workpiece presser, than a speed at a time when the bobbin-thread cutting mechanism draws the bobbin thread from the bobbin.

13 Claims, 9 Drawing Sheets

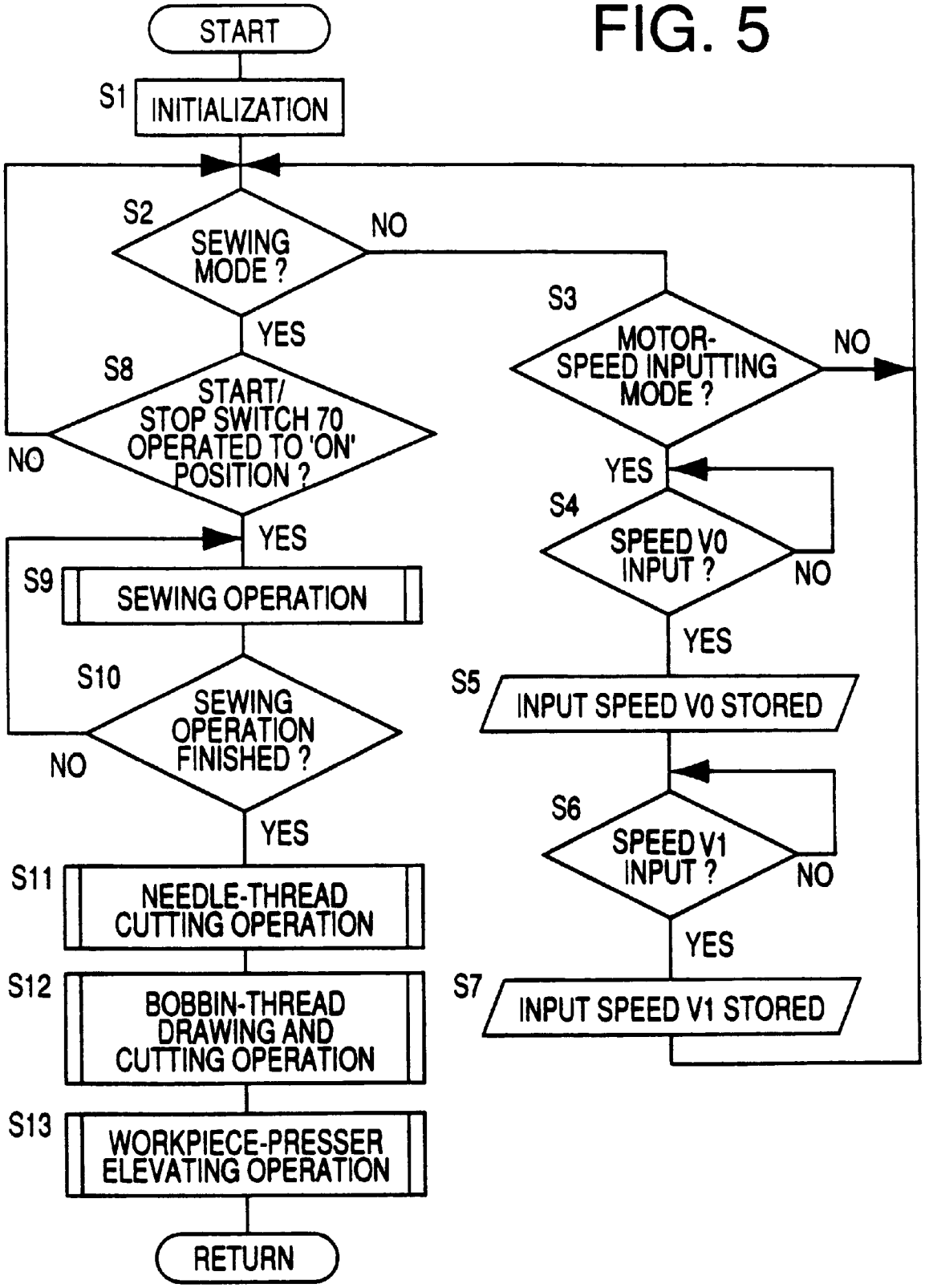
FIG. 5
START
S1
INITIALIZATION
S2
SEWING MODE ?
NO
YES
S3
MOTOR-SPEED INPUTTING MODE ?
NO
YES
S4
SPEED V0 INPUT ?
NO
YES
S5
INPUT SPEED V0 STORED
S6
SPEED V1 INPUT ?
NO
YES
S7
INPUT SPEED V1 STORED
S8
START/ STOP SWITCH 70 OPERATED TO 'ON' POSITION ?
NO
YES
S9
SEWING OPERATION
S10
SEWING OPERATION FINISHED ?
NO
YES
S11
NEEDLE-THREAD CUTTING OPERATION
S12
BOBBIN-THREAD DRAWING AND CUTTING OPERATION
S13
WORKPIECE-PRESSER ELEVATING OPERATION
RETURN

HOLING SEWING MACHINE

BACKGROUND OF THE INVENTION

1. Field of the Invention

The present invention relates to a holing sewing machine and in particular to such a holing sewing machine which includes a workpiece-presser elevating and lowering mechanism, a needle-thread cutting mechanism, a bobbin-thread cutting mechanism, and an interlocking mechanism which mechanically interlocks the above three mechanisms to one another.

2. Related Art Statement

A generally known holing sewing machine that forms holing stitches for, e.g., a button hole, includes a workpiece-presser elevating and lowering mechanism which elevates and lowers a workpiece presser; a needle-thread cutting mechanism which cuts a needle thread conveyed by a sewing needle; a bobbin-thread cutting mechanism which cuts a bobbin thread supplied from a bobbin; an interlocking mechanism which mechanically interlocks the above three mechanisms with one another; and a drive device which drives those three mechanisms via the interlocking mechanism. Thus, the holing sewing machine is constructed to be able to perform the cutting of the needle and bobbin threads and the elevating of the workpiece presser in a substantially continuous manner. A pedal-operated drive device is generally known as the above-indicated drive device. The pedal-operated drive device includes a foot pedal which is pushed by a foot of a user; and a chain member which drives the above three mechanism when the foot pedal is pushed by the user's foot.

FIG. 9 shows a generally known bobbin-thread cutting mechanism 100. A cam lever 102 is fixed to a right-hand end portion of a horizontal axis member 101 which is pivotally supported by a frame of a holing sewing machine. A roller member 103 which is attached to a rear end portion of the cam lever 102 is engaged with a cam groove 105 of a plate cam 104 which is supported by the machine frame such that the plate cam 104 is pivotable about a horizontal axis line. When a first operative lever 106 fixed to a left-hand end portion of the axis member 101 is pivoted in a direction indicated at an arrow by a chain member 119 being pulled by a foot pedal (not shown), the axis member 101 and the cam lever 102 are pivoted as a unit with the first operative lever 106. Since the roller member 103 is engaged with the cam groove 105, the plate cam 104 is pivoted in a direction indicated at an arrow.

A rear end portion of a bobbin-thread-cut link 110 is connected via a pin to the plate cam 104, and a rear end portion of a second operative lever 111 is connected to a front end portion of the bobbin-thread-cut link 110. A movable blade 112 and a bobbin-thread-draw member 113 are fixed to a front end portion of the second operative lever 111. When the plate cam 104 is pivoted in the direction indicated at the arrow, the bobbin-thread-cut link 110 is moved rearward, the movable blade 112 and the bobbin-thread-draw member 113 are pivoted as a unit with the second operative lever 111, about a stepped screw 114, in a direction indicated at an arrow.

When the movable blade 112 and the bobbin-thread-draw member 113 are pivoted in the direction indicated at the arrow, first, a predetermined amount or length of a bobbin thread is drawn from a bobbin (not shown) by the bobbin-thread-draw member 113, and then the movable blade 112 cooperates with a fixed blade 115 to cut the bobbin thread. The present bobbin-thread cutting mechanism 100 is mechanically interlocked with a workpiece-presser elevating and lowering mechanism and a needle-thread cutting mechanism (not shown) by an interlocking mechanism 118 including a link member 117. The chain member 119 and the foot pedal cooperate with each other to provide a pedal-operated drive device which drives the three mechanisms via the interlocking mechanism 118.

However, the known holing sewing machine including the above-described four mechanisms and drive device suffers from the problem that if the bobbin-thread cutting mechanism 100 is operated at a high speed by the pedal-operated drive device, the bobbin thread may be broken when the thread is drawn from the bobbin by the bobbin-thread-draw member 113 before being cut by the cooperation of the movable and fixed blades 112, 115. Thus, the bobbin-thread cutting mechanism 100 cannot be operated at so high speeds. In this sort of holing sewing machine, since the user needs to operate the foot pedal, he or she feels a great operation load. In addition, since the user needs to operate carefully the foot pedal for the bobbin-thread-draw member 113 so as not to brake the bobbin thread, the efficiency of operation of the sewing machine cannot be improved.

Recently, an air-operated cylinder device or a solenoid-operated actuator is used as a drive device for operating the above-indicated three mechanism. However, each of those actuators is operated such that the speed of operation of the each actuator is not changed.

SUMMARY OF THE INVENTION

It is therefore an object of the present invention to provide a holing sewing machine which can cut a needle thread and a bobbin thread and elevate a workpiece presser, in a shortened cycle time, without braking the bobbin thread when the bobbin thread is drawn from a bobbin.

The present invention provides a holing sewing machine which has one or more of the technical features that are described below in respective paragraphs given parenthesized sequential numbers (1) to (13). Any technical feature that includes another technical feature shall do so by referring, at the beginning, to the parenthesized sequential number given to that technical feature. Thus, two or more of the following technical features may be combined, if appropriate. Each technical feature may be accompanied by a supplemental explanation, as needed. However, the following technical features and the appropriate combinations thereof are just examples to which the present invention should not be limited.

(1) According to a first feature of the present invention, there is provided a holing sewing machine comprising a workpiece-presser elevating and lowering mechanism which elevates and lowers a workpiece presser which presses at least one workpiece; a needle-thread cutting mechanism which cuts a needle thread conveyed by a sewing needle; a bobbin-thread cutting mechanism which draws a bobbin thread from a bobbin and cuts the bobbin thread; an interlocking mechanism which mechanically interlocks the workpiece-presser elevating and lowering mechanism, the needle-thread cutting mechanism, and the bobbin-thread cutting mechanism, with one another, such that the elevating and lowering mechanism elevates the workpiece presser after the needle-thread cutting mechanism cuts the needle thread and the bobbin-thread cutting mechanism cuts the bobbin thread; a drive source which is connected to the interlocking mechanism and which drives the interlocking mechanism to operate the workpiece-presser elevating and lowering mechanism, the needle-thread cutting mechanism, and the bobbin-thread cutting mechanism, the drive source being controllable with respect to a speed of operation thereof to drive the interlocking mechanism; and a control device which is connected to the drive source and which controls the drive source such that the drive source is operated at a higher speed at at least one of a time when the needle-thread cutting mechanism cuts the needle thread and a time when the elevating and lowering mechanism elevates the workpiece presser, than a speed at a time when the bobbin-thread cutting mechanism draws the bobbin from the bobbin. The workpiece may be a fabric sheet or a leather sheet. The drive source may comprise an electric motor such as a stepper motor or a servomotor, or a different actuator such as a solenoid-operated actuator or an air-pressure-operated cylinder device. The cutting of the bobbin thread may occur either after or before the cutting of the needle thread. Since the drive source is operated at d higher speed when the needle thread is cut and/or a speed when the workpiece presser is elevated, than a speed when the bobbin thread is drawn from the bobbin. Therefore, the cutting of the needle and bobbin threads and the elevating of the workpiece presser can be performed in a shortened cycle time, while the bobbin thread is effectively prevented from being broken when being drawn from the bobbin. Thus, the present sewing machine enjoys an improved operation or production efficiency.

(2) According to a second feature of the present invention that includes the first feature (1), the holing sewing machine further comprises a cam mechanism which transmits a driving force of the drive source via the interlocking mechanism to the workpiece-presser elevating and lowering mechanism, the needle-thread cutting mechanism, and the bobbin-thread cutting mechanism. The cam mechanism which can reliably transmit the driving force of the drive source to the interlocking mechanism, has a simple construction, which contributes to reducing the production cost of the present sewing machine as a whole.

(3) According to a third feature of the present invention that includes the first feature (1), the holing sewing machine further comprises a gear mechanism which transmits a driving force of the drive source via the interlocking mechanism to the workpiece-presser elevating and lowering mechanism, the needle-thread cutting mechanism, and the bobbin-thread cutting mechanism. The gear mechanism which can reliably transmit the driving force of the drive source to the interlocking mechanism, has a simple construction, which contributes to reducing the production cost of the present sewing machine as a whole.

(4) According to a fourth feature of the present invention that includes any one of the first to third features (1) to (3), the drive source comprises an electric motor selected from the group consisting of a stepper motor and a servomotor. The use of the stepper motor and the servomotor contributes to reducing the production cost of the present sewing machine as a whole.

(5) According to a fifth feature of the present invention that includes any one of the first to fourth features (1) to (4), the drive source comprises an electric motor selected from the group consisting of a rotary motor and a linear motor.

(6) According to a sixth feature of the present invention, there is provided a holing sewing machine comprising a workpiece-presser elevating and lowering mechanism which elevates and lowers a workpiece presser which presses at least one workpiece; a needle-thread cutting mechanism which cuts a needle thread conveyed by a sewing needle; a bobbin-thread cutting mechanism which draws a bobbin thread from a bobbin and cuts the bobbin thread; an interlocking mechanism which mechanically interlocks the workpiece-presser elevating and lowering mechanism, the needle-thread cutting mechanism, and the bobbin-thread cutting mechanism, with one another; a stepper motor which drives the interlocking mechanism to operate the workpiece-presser elevating and lowering mechanism, the needle-thread cutting mechanism, and the bobbin-thread cutting mechanism; and a control device which controls the stepper motor such that the stepper motor is operated at a changeable speed. In the present holing sewing machine, the control device may control the stepper motor such that, when the bobbin thread is drawn from the bobbin, the stepper motor is operated at a first speed so predetermined as not to brake the bobbin thread and, when the needle thread is cut and when the workpiece presser is elevated, the stepper motor is operated at a second speed higher than the first speed. Thus, the cutting of the needle and bobbin threads and the elevating of the workpiece presser can be performed in a shortened cycle time, while the bobbin thread is effectively prevented from being broken when being drawn from the bobbin. Thus, the present sewing machine enjoys an improved operation or production efficiency. Alternatively, the control device may control the stepper motor such that, when the bobbin thread is drawn from the bobbin and when the needle thread is cut, the stepper motor is operated at a first speed so predetermined as not to brake the bobbin thread and, when the workpiece presser is elevated, the stepper motor is operated at a second speed higher than the first speed. In this case, too, the cutting of the needle and bobbin threads and the elevating of the workpiece presser can be performed in a shortened cycle time, while the bobbin thread is prevented from being broken when being drawn from the bobbin.

(7) According to a seventh feature of the present invention that includes the sixth feature (6), the interlocking mechanism interlocks the workpiece-presser elevating and lowering mechanism, the needle-thread cutting mechanism, and the bobbin-thread cutting mechanism, with one another, such that the elevating and lowering mechanism elevates the workpiece presser after the needle-thread cutting mechanism cuts the needle thread and the bobbin-thread cutting mechanism cuts the bobbin thread, and the control device controls the stepper motor such that the stepper motor is operated at a higher speed at at least one of a time when the needle-thread cutting mechanism cuts the needle thread and a time when the elevating and lowering mechanism elevates the workpiece presser, than a speed at a time when the bobbin-thread cutting mechanism draws the bobbin from the bobbin.

(8) According to an eighth feature of the present invention that includes the sixth or seventh feature (6) or (7), the holing sewing machine further comprises a cam mechanism which transmits a driving force of the stepper motor via the interlocking mechanism to the workpiece-presser elevating and lowering mechanism, the needle-thread cutting mechanism, and the bobbin-thread cutting mechanism.

(9) According to a ninth feature of the present invention that includes the sixth or seventh feature (6) or (7), the holing sewing machine further comprises a gear mechanism which transmits a driving force of the stepper motor via the interlocking mechanism to the workpiece-presser elevating and lowering mechanism, the needle-thread cutting mechanism, and the bobbin-thread cutting mechanism.

(10) According to a tenth feature of the present invention, there is provided a holing sewing machine comprising a workpiece-presser elevating and lowering mechanism which elevates and lowers a workpiece presser which presses at least one workpiece; a needle-thread cutting mechanism which cuts a needle thread conveyed by a sewing needle; a bobbin-thread cutting mechanism which draws a bobbin thread from a bobbin and cuts the bobbin thread; an interlocking mechanism which mechanically interlocks the workpiece-presser elevating and lowering mechanism, the needle-thread cutting mechanism, and the bobbin-thread cutting mechanism, with one another; a drive source which is connected to the interlocking mechanism and which drives the interlocking mechanism to operate the workpiece-presser elevating and lowering mechanism, the needle-thread cutting mechanism, and the bobbin-thread cutting mechanism, the drive source being controllable with respect to a speed of operation thereof to drive the interlocking mechanism; a speed-data obtaining device which obtains a first set of speed data and a second set of speed data, independent of each other, the first set of speed data being indicative of a first speed of the drive source at at least one of a time when the needle-thread cutting mechanism cuts the needle thread and a time when the elevating and lowering mechanism elevates the workpiece presser, the second set of speed data being indicative of a second speed of the drive source at a time when the bobbin-thread cutting mechanism draws the bobbin from the bobbin; and a control device which is connected to the speed-data obtaining device and the drive source and which controls, based on each of the first and second sets of speed data obtained by the speed-data obtaining device, the drive source such that the drive source is operated at a corresponding one of the first and second speeds indicated by the first and second sets of speed data. The speed-data obtaining device may comprise an input device, such as a keyboard, which is manually operable by a user for inputting at least one of the first and second sets of speed data; or a memory, such as a read only memory (ROM), in which at least one of the first and second sets of speed data is stored in advance. The user can input the first and second sets of speed data indicative of the most appropriate first and second speeds, respectively. Thus, the cutting of the needle and bobbin threads and the elevating of the workpiece presser can be carried out in a shortened cycle time, while the bobbin thread is effectively prevented from being broken when being drawn from the bobbin. Therefore, the present sewing machine enjoys an improved operation or production efficiency. The memory may store the first and second sets of speed data indicative of the first and second speeds as default values. The user can change, as needed, one or each of the two default values by inputting a new set of first speed data and/or a new set of second speed data via the input device.

(11) According to an eleventh feature of the present invention that includes the tenth feature (10), the interlocking mechanism interlocks the workpiece-presser elevating and lowering mechanism, the needle-thread cutting mechanism, and the bobbin-thread cutting mechanism, with one another, such that the elevating and lowering mechanism elevates the workpiece presser after the needle-thread cutting mechanism cuts the needle thread and the bobbin-thread cutting mechanism cuts the bobbin thread, and the control device controls the drive source such that the drive source is operated at the at least one of the time when the needle-thread cutting mechanism cuts the needle thread and the time when the elevating and lowering mechanism elevates the workpiece presser, at the first speed higher than the second speed at which the drive source is operated at the time when the bobbin-thread cutting mechanism draws the bobbin from the bobbin.

(12) According to a twelfth feature of the present invention that includes the tenth or eleventh feature (10) or (11), the speed-data obtaining device comprises an input device which is connected to the control device and which is operable by a user for inputting at least one of the first and second sets of speed data.

(13) According to a thirteenth feature of the present invention that includes any one of the tenth to twelfth feature (10) to (12), the holing sewing machine further comprises a memory in which at least one of the first and second sets of speed data is stored, and the speed-data obtaining device reads the at least one set of speed data from the memory. In this case, the speed-data obtaining device and the control device may be provided by a single computer.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which:

FIG. 5 is a flow chart representing a motor-speed inputting and sewing control program which is carried out by the control device of FIG. 4;

DETAILED DESCRIPTION OF THE PREFERRED EMBODIMENTS

Figure 2A:
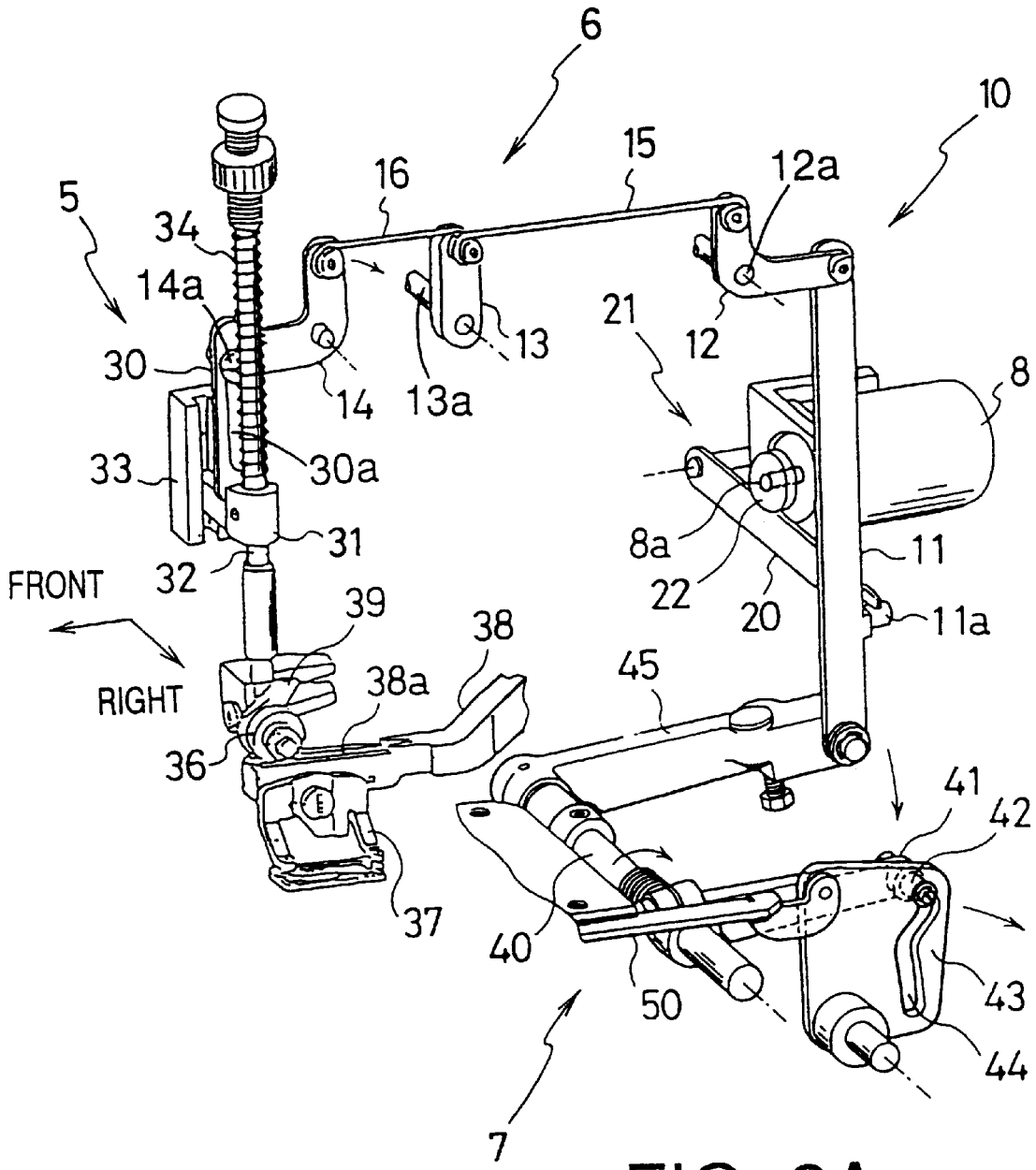
FIG. 2A is a perspective view of a workpiece-presser elevating and lowering mechanism and a bobbin-thread cutting mechanism of the holing sewing machine of FIG. 1.

Hereinafter, there will be described a holing sewing machine, M, to which the present invention is applied. As shown in FIG. 2A, the holing sewing machine M includes a workpiece-presser elevating and lowering mechanism 5 (FIG. 2A) which elevates and lowers a workpiece presser 37; a needle-thread cutting mechanism 6 (FIGS. 2A and 2B) which cuts a needle thread conveyed by a sewing needle (not shown); a bobbin-thread drawing and cutting mechanism 7 (FIGS. 2A and 3) which cuts a bobbin thread supplied from a bobbin (not shown); and an interlocking and connecting mechanism 10 which mechanically interlocks the above three mechanisms 5, 6, 7 with one another, and mechanically connects the three mechanisms 5, 6, 7 to a common drive source, i.e., a stepper motor 8 such that the three mechanisms 5, 6, 7 are operated, strictly, at respective different timings, but apparently, substantially continuously, that is, first the needle-thread cutting mechanism 6 cuts the needle thread, second the bobbin-thread drawing and cutting mechanism 7 cuts the bobbin thread, and then the workpiece-presser elevating and lowering mechanism 5 elevates the workpiece presser 37.

Figure 1:
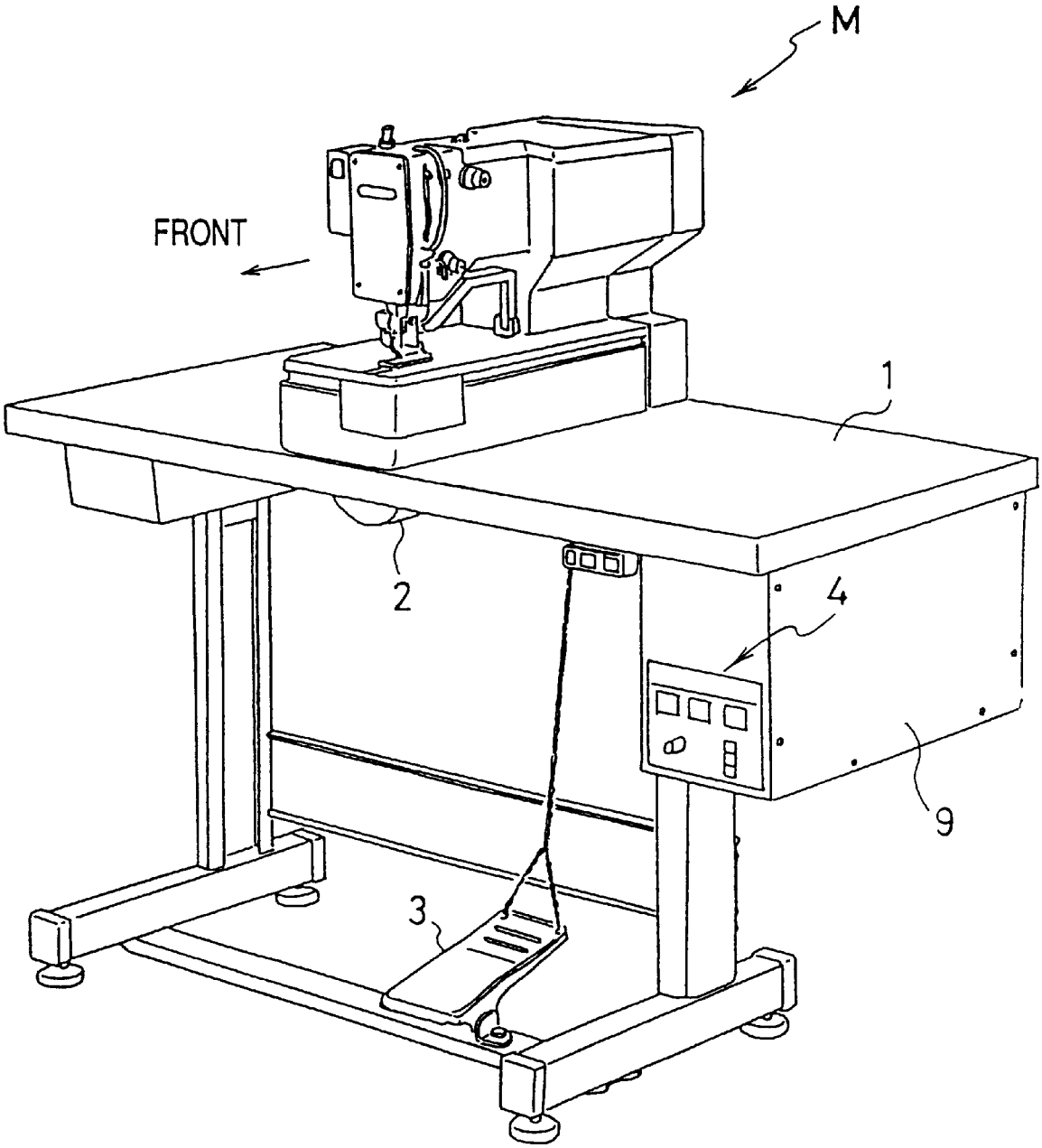
FIG. 1 is a perspective view of a holing sewing machine to which the present invention is applied.

As shown in FIG. 1, the present sewing machine M includes a machine table 1. The machine table 1 is provided with a main motor 2; a pedal 3 for operating a start/stop switch 70 (FIG. 4); an operation panel 4 for inputting various sorts of data, such as data needed to form a button hole and data needed to form button-holing stitches, and displaying the input data; a mode selecting switch 71 for selecting one of a sewing mode and a motor-speed inputting mode; a motor-speed inputting key 72 for inputting a desired speed of the stepper motor 8 as the common drive source of the workpiece-presser elevating and lowering mechanism 5, the needle-thread cutting mechanism 6, and the bobbin-thread drawing and cutting mechanism 7; and a control device 9 for controlling respective operations of the main motor 2 and the stepper motor 8.

The interlocking and connecting mechanism 10 includes a vertically long link 11; a first L-shaped link 12 which is supported via an axis member 12*a* by a frame of the machine M (hereinafter, referred to as the "machine frame"), such that the first L-shaped link 12 is pivotable about a horizontal axis line, and whose rear end portion is connected, via a pin, to an upper end portion of the long link 11; a short link 13 which is supported via an axis member 13*a* by the machine frame such that the short link 13 is pivotable about a horizontal axis line and whose upper end portion is connected via a first wire 15 to an upper end portion of the first L-shaped link 12; and a second L-shaped link 14 which is supported by the machine frame such that the second L-shaped link 14 is pivotable about a horizontal axis line and whose upper end portion is connected via a second wire 16 to an upper end portion of the short link 13.

On the left-hand side of the long link 11, there is provided a drive link 20 which is supported by the machine frame such that the drive link 20 is pivotable about a horizontal axis line. A right-hand end portion of the drive link 20 is engaged with an upper surface of a projecting portion 11*a* which horizontally projects from an intermediate portion of the long link 11. The stepper motor 8 has a horizontal output shaft 8*a* to which a circular plate cam 22 of a cam mechanism 21 is eccentrically fixed. An outer circumferential surface of the plate cam 22 is engaged or contacted with an upper surface of a lengthwise intermediate portion of the drive link 20.

When the stepper motor 8 is rotated, the plate cam 22 is rotated. As the distance between the center of rotation of the plate cam 22 and a contact portion of the cam 22 at which the outer circumferential surface of the cam 22 contacts the upper surface of the drive link 20, gradually increases, the drive link 20 is pivoted downward by being pushed down by the cam 22, so that the long link 11 is moved downward. The downward movement of the long link 11 causes the three links 12, 13, 14 to be pivoted clockwise in FIG. 2A. On the other hand, as the above-indicated distance gradually decreases, the three link 12, 13, 14 are pivoted counterclockwise, because of a biasing force of a compression coil spring 34 of the workpiece-presser elevating and lowering mechanism 5, so that the long link 11 is moved upward.

Next, the workpiece-presser elevating and lowering mechanism 5 will be described.

A pin 14*a* which is attached to a front end portion of the second L-shaped link 14 of the interlocking and connecting mechanism 5 is movably engaged with an elongate hole 30*a* of a presser-elevate link 30. A lower end portion of the presser-elevate link 30 is connected to a presser-bar holder 31, which is guided by a guide member 33 such that the presser-bar holder 31 is movable upward and downward. A presser bar 32 is fixed to the presser-bar holder 31, in the state in which the presser bar 32 extends through the holder 31. The compression coil spring 34 which biases the presser-bar holder 31 downward is externally fitted around an upper portion of the presser bar 32 that is located above the holder 31.

A presser roller 36 which is attached to a lower end portion of the presser bar 32 is rollably engaged with a groove 38*a* which is formed in a front, upper surface of a feed arm 38 to which the workpiece presser 37 is attached. Thus, the feed arm 38 (or the workpiece presser 37) is movable frontward and rearward, in the state in which the fee arm 38 is pressed downward by the presser roller 36. An engaging member 39 is provided on a front end portion of the feed arm 38. In the state in which the presser roller 36 is engaged with the engaging member 39, the feed arm 38 and the workpiece presser 37 are moved upward and downward by the presser bar 32.

When the distance between the center of rotation of the plate cam 22 and the contact portion of the cam 22 at which the cam 22 contacts the drive link member 20 takes a minimum value, the long link 11 is positioned at its upper stroke-end position. In this state, the biasing force of the compression coil spring 34 biases the workpiece presser 37 downward via the presser-bar holder 31, the presser bar 32, the presser roller 36, and the feed arm 38, so that a workpiece (not shown), such as a fabric sheet or a leather sheet, is held between the workpiece presser 37 and a feed table (not shown).

If the stepper motor 8 is rotated starting with this state, the distance between the center of rotation of the plate cam 22 and the contact portion of the cam 22 gradually increases, so that the long link 11 is moved downward via the cam mechanism 21 and the drive link 20. Eventually, the second L-shaped link 14 is pivoted in a direction indicated at an arrow. With a short time delay after the commencement of the above pivotal motion of the second L-shaped link 14, the link 14 transmits an elevating force to the presser-elevate link member 30, so that the workpiece presser 37 is elevated. Before the workpiece presser 37 is elevated, the needle-thread cutting mechanism 6 cuts the needle thread and subsequently the bobbin-thread drawing and cutting mechanism 7 draws and cuts the bobbin thread.

Figure 2B:
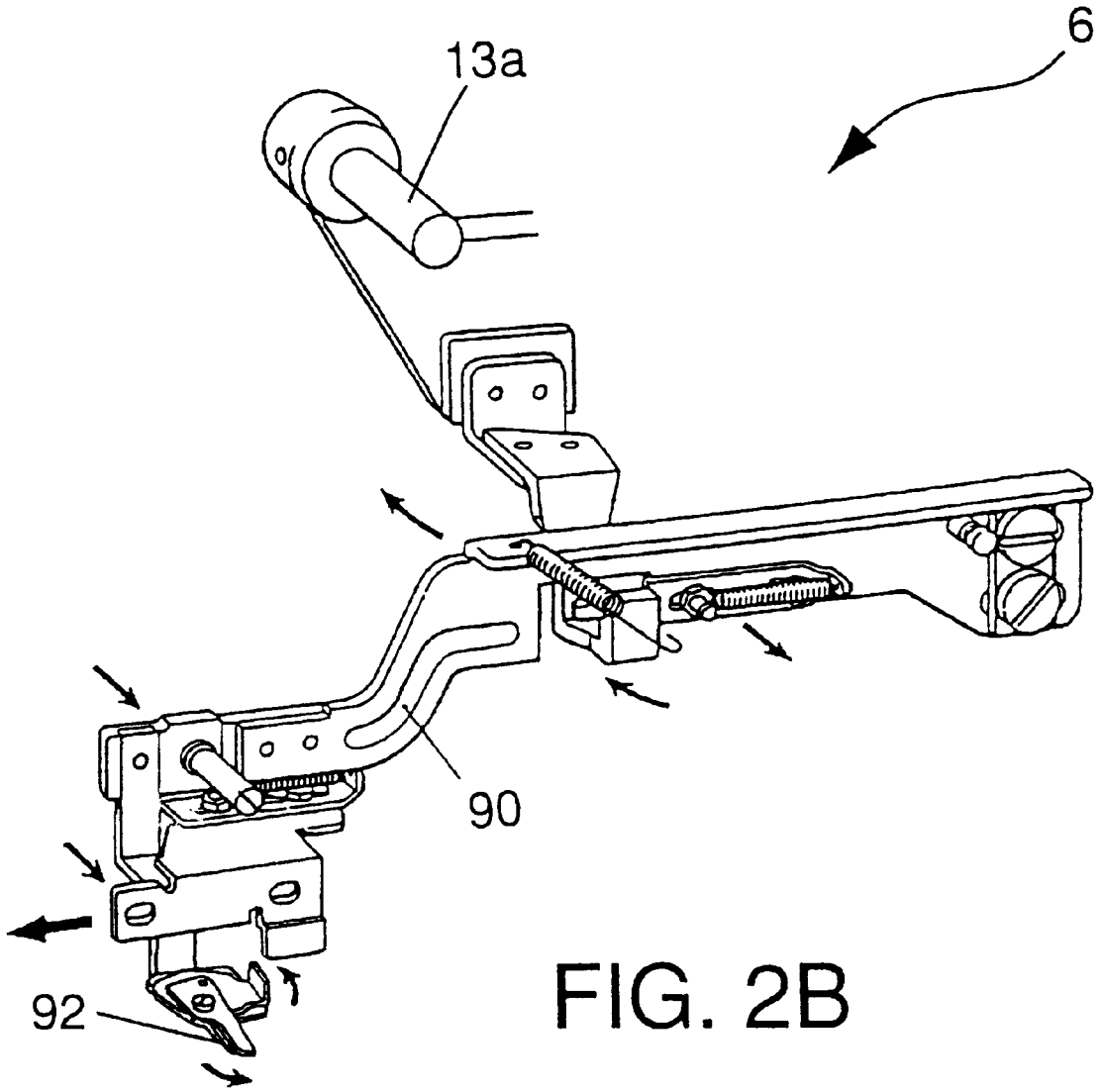
FIG. 2B is a perspective view of a needle-thread cutting mechanism of the holing sewing machine of FIG. 1.

Next, the needle-thread cutting mechanism 6 will be described by reference to FIGS. 2A and 2B. However, since this mechanism 6 is well known in the art, it will be described briefly. When the stepper motor 8 is rotated, the long link 11 is moved downward, so that the short link 13 is pivoted clockwise in FIG. 2A. Thus, the axis member 13*a* is rotated clockwise in FIG. 2A or FIG. 2B. Consequently, a needle-thread-cut lever 90 is driven and a pair of scissors 92 is driven to cut the needle thread.

Next, the bobbin-thread drawing and cutting mechanism 7 will be described.

Figure 3:
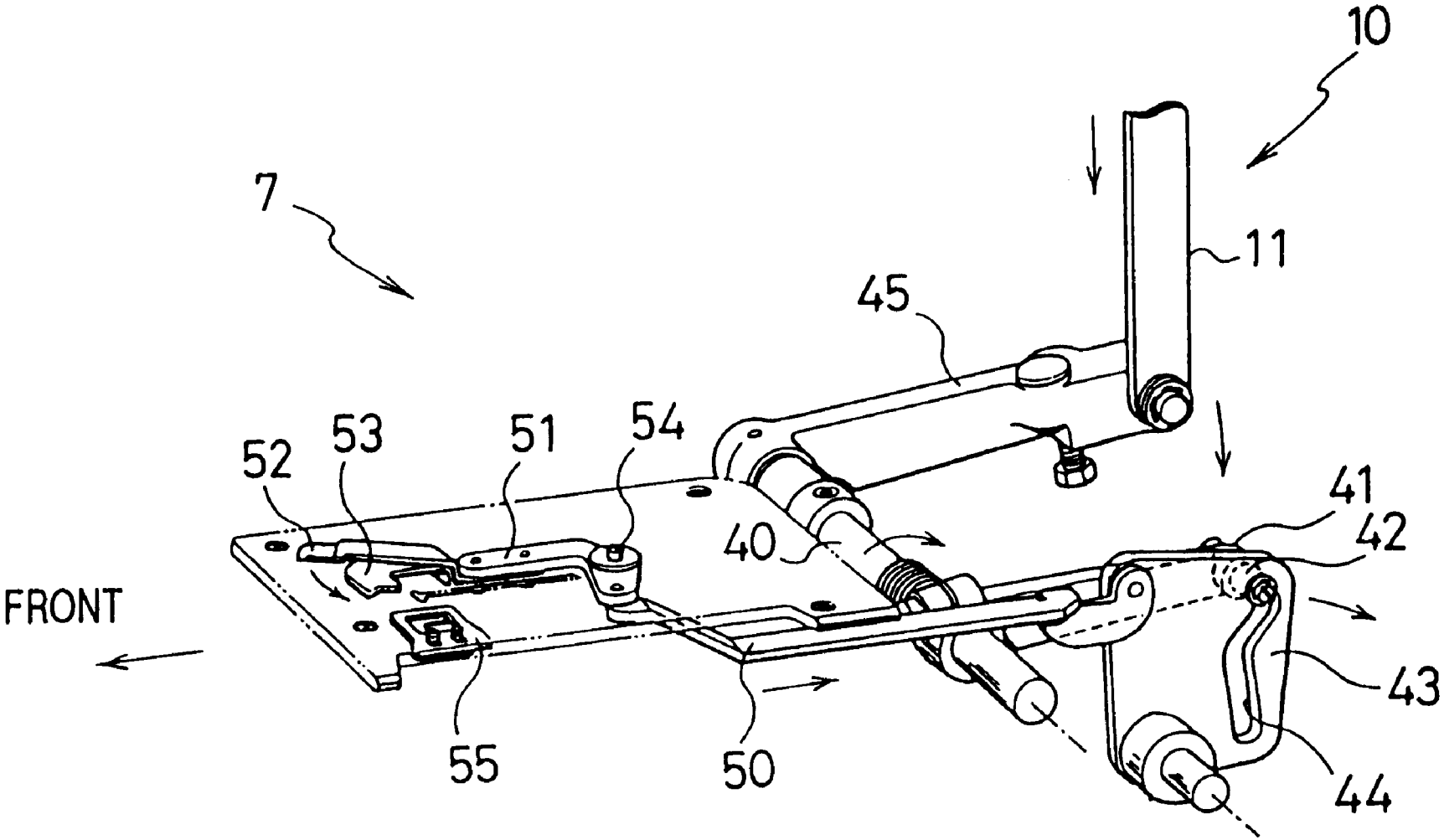
FIG. 3 is an enlarged perspective view of the bobbin-thread cutting mechanism of FIG. 2A.

As shown in FIG. 3, a cam lever 41 is fixed to a right-hand end portion of a horizontal axis member 40 which is pivotally supported by the machine frame. A roller member 42 which is attached to a rear end portion of the cam lever 41 is engaged with a cam groove 44 of a plate cam 43 which is supported by the machine frame such that the plate cam 43 is pivotable about a horizontal axis line. When the long link 11 of the interlocking and connecting mechanism 10 is moved downward, a first operative lever 45 fixed to a left-hand end portion of the axis member 40 is pivoted in a direction indicated at an arrow, so the axis member 40 and the cam lever 41 are pivoted as a unit with the first operative lever 45. Since the roller member 42 is engaged with the cam groove 44, the plate cam 43 is pivoted in a direction indicated at an arrow.

A rear end portion of a bobbin-thread-cut link 50 is connected via a pin to the plate cam 43, and a rear end portion of a second operative lever 51 is connected to a front end portion of the bobbin-thread-cut link 50. A movable blade 52 and a bobbin-thread-draw member 53 are fixed to a front end portion of the second operative lever 51. When the plate cam 43 is pivoted in the direction indicated at the arrow, the bobbin-thread-cut link 50 is moved rearward, the movable blade 52 and the bobbin-thread-draw member 53 are pivoted as a unit with the second operative lever 51, about a screw 54, in a direction indicated at an arrow.

When the movable blade 52 and the bobbin-thread-draw member 53 are pivoted in the direction indicated at the arrow, first, a predetermined amount or length of the bobbin thread is drawn from the bobbin (not shown) by the bobbin-thread-draw member 53, and then the movable blade 52 cooperates with a fixed blade 55 to cut the bobbin thread.

Next, there will be described a control system of the holing sewing machine M that includes a control device 9.

Figure 4:
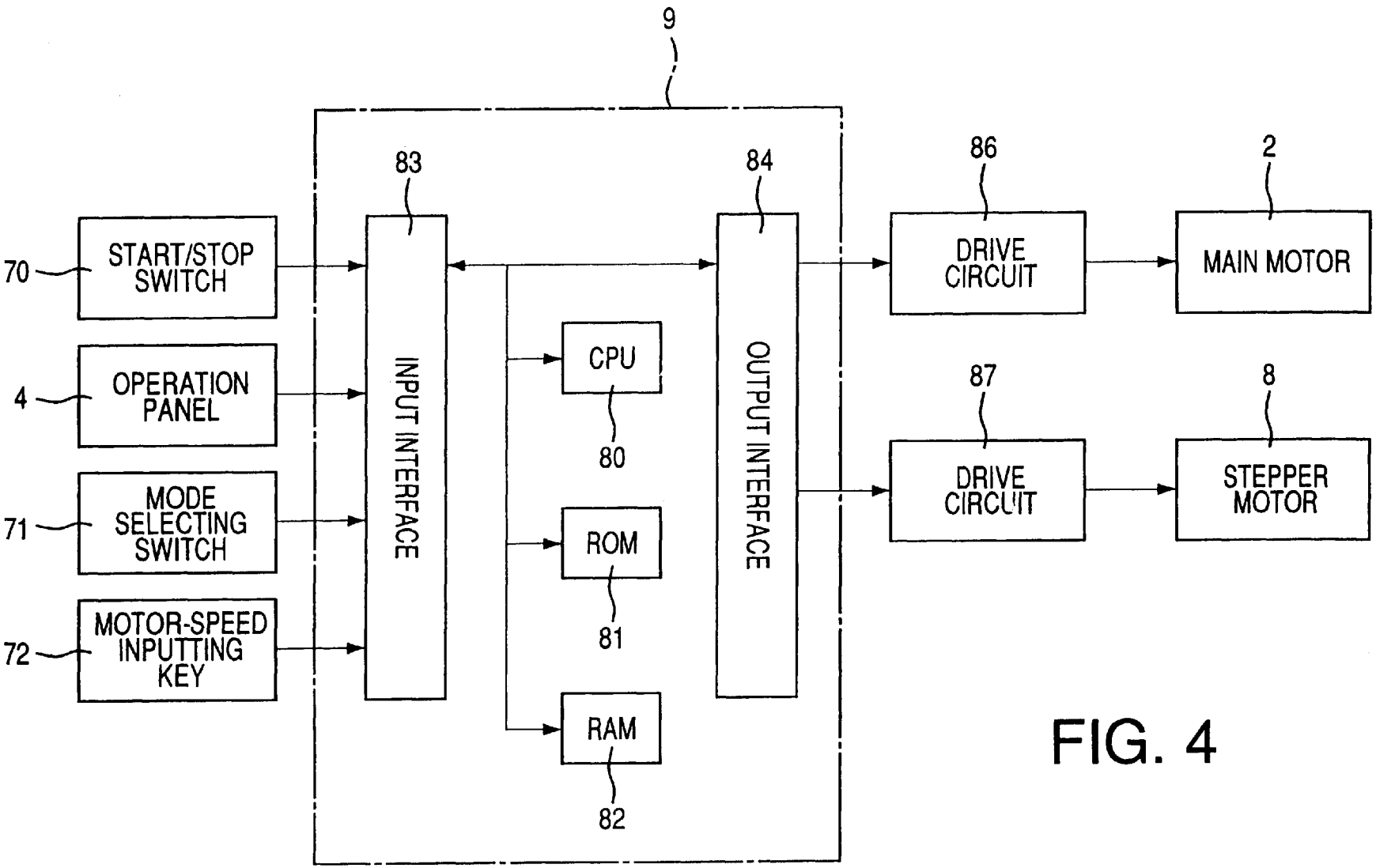
FIG. 4 is a block diagram of a control device of the holing sewing machine of FIG. 1.

As shown in FIG. 4, the control device 9 includes a central processing unit (CPU) 80, a read only memory (ROM) 81, a random access memory (RAM) 82, an input interface 83, an output interface 84, and a bus 85 (e.g., a data bus) which connects the elements 80, 81, 82, 83, 84 to one another. The input interface 83 receives respective control signals and pulse signals from the start/stop switch 70, the operation panel 4, the mode selecting switch 71, and the motor-speed inputting key 72. The output interface 84 outputs respective control signals to a drive circuit 86 for the main motor 2 and a drive circuit 87 for the stepper motor 8.

The ROM 81 stores various control programs including a sewing control program according to which the main motor 2 is controlled based on a batch of sewing data, so that stitches are formed on the workpiece; a motor-speed-input control program according to which a user inputs a speed, V0 (FIG. 6), at which the stepper motor 8 is rotated when the bobbin thread is drawn from the bobbin by the bobbin-thread-draw member 53 immediately before the bobbin thread is cut by the movable and fixed blades 52, 55; and a speed, V1, at which the stepper motor 8 is rotated when the needle thread is cut by the needle-thread cutting mechanism 6 and when the workpiece presser 37 is elevated by the workpiece-presser elevating and lowering mechanism 7; and a thread-cut and workpiece-presser-elevate control program according to which the stepper motor 8 is rotated at the thus input speeds when the bobbin thread is drawn from the bobbin, when the needle thread is cut, and when the workpiece presser 37 is elevated.

The RAM 82 includes various pointers, counters, flags, and buffers needed for carrying out the above-indicated control programs; and various memories for temporarily storing the results of calculations of the CPU 80.

In the present embodiment, the stepper motor 8 provides a drive device; the control device 9 provide a control device; and the motor-speed inputting key 72 and the control device 9 cooperate with each other to provide a speed-data inputting device.

Next, there will be described the operations of the control device 9 according to the above-indicated sewing control program, the motor-speed-input control program, and the thread-cut and workpiece-presser-elevate control program, by reference to the flow chart of FIG. 5.

Upon application of an electric power to the present sewing machine M, the control of the CPU 80 begins with Step S1 at which the CPU 80 initializes the control device 9. Step S1 is followed by Step S2 to judge whether the mode selecting switch 71 indicates the selection of the sewing mode. If a negative judgment is made at Step S2, the control of the CPU 80 goes to Step S3 to judge whether the mode selecting switch 71 indicates the selection of the motor-speed inputting mode. If a positive judgment is made at Step S3, the control goes to Step S4 to allow a user to operate the motor-speed inputting key 72 and then operate the operation panel 4 for inputting a desired speed V0 at which the stepper motor 8 is rotated when the bobbin thread is drawn from the bobbin by the bobbin-thread-draw member 53 immediately before the bobbin thread is cut by the movable and fixed blades 52, 55. If the user inputs the desired speed V0 and accordingly a positive judgment is made at Step S4, the control of the CPU 80 goes to Step S5 to store data indicative of the input speed V0, in the RAM 82. Step S5 is followed by Step S6 to allow the user to input a desired speed V1 at which the stepper motor 8 is rotated when the needle thread is cut and when the workpiece presser 37 is elevated.

If the user inputs the desired speed V1 and accordingly a positive judgment is made at Step S6, the control of the CPU 80 goes to Step S7 to store data indicative of the input speed V1, in the RAM 82. Then, the control of the CPU 80 returns to Step S2. If the mode selecting switch 71 does not indicate the selection of the motor-speed inputting mode and accordingly a negative judgment is made at Step S3, the control also returns to Step S2. Then, if the user operates the mode selecting switch 71 to select the sewing mode in place of the motor-speed inputting mode, a positive judgment is made at Step S2. Accordingly, the control of the CPU 80 goes to Step S8 to judge whether the start/stop switch 70 has been operated to its START or ON position by the user. If a positive judgment is made at Step S8, the control goes to Step S9 to carry out the above-indicated sewing control program. Step S9 is followed by Step S10 to judge whether a sewing operation according to the sewing control program has been finished. If a positive judgment is made at Step S10, the control goes to Steps S11, S12, and S13 to carry out a needle-thread cutting operation at Step S11, a bobbin-thread drawing and cutting operation at Step S12, and a workpiece-presser elevating operation at Step S13, according to the above-indicated thread-cut and workpiece-presser-elevate control program.

The needle-thread cutting operation, the bobbin-thread drawing and cutting operation, and the workpiece-presser elevating operation will be described by reference to the graph, shown in FIG. 6, which has an axis of abscissas indicative of an operation time, t, of the stepper motor 8 and an axis of ordinates indicative of a speed, v, of the motor 8. It is assumed that the start time, 0, of the operation time t corresponds to the time when the distance between the center of rotation of the plate cam 22 and the contact portion thereof with the drive link 20 takes its minimum value, that is, the time when the long link 11 of the interlocking and connecting mechanism 10 takes its upper stroke-end position.

First, the control device 9 controls the stepper motor 8 such that the speed of the motor 8 is increased up to the input and stored speed V1 in a time period between the start time 0 and a first time, T1, and the needle-thread cutting mechanism 6 cuts the needle thread while the motor 8 is rotated at the high speed V1. The bobbin-thread drawing and cutting mechanism 7 cuts the bobbin thread in a time period between the first time T1 and a third time, T3. More specifically described, the control device 9 controls the stepper motor 8 such that the speed of the motor 8 is decreased down to the input and stored speed V0 in a time period between the first time T1 and a second time, T2, and the bobbin-thread drawing and cutting mechanism 7 draws the bobbin thread from the bobbin while the motor 8 is rotated at the low speed V0. However, the low motor speed V0 may be an upper-limit value of a permission speed range that permits the bobbin-thread-draw member 53 to draw the bobbin thread from the bobbin without braking the threat. The movable and fixed blades 52, 55 cooperate with each other to cut the bobbin thread immediately after the bobbin-thread-draw member 53 draws a certain length of the bobbin thread from the bobbin.

Subsequently, the control device 9 controls the stepper motor 8 such that the speed of the motor 8 is increased up to the input and stored speed V1 in a time period between the second time T2 and the third time T3, and the workpiece-presser elevating and lowering mechanism 5 elevates the workpiece presser 37 in a time period between the third time T3 and an end time, Tb. Thus, the workpiece presser 37 is elevated while the motor 8 is rotated at the high speed V1. That is, the speed of the stepper motor 8 is controlled such that the motor speed V1 when the needle thread is cut and when the workpiece presser 37 is elevated is higher than the motor speed V0 when the bobbin thread is drawn from the bobbin.

In the case where the start/stop switch 70 is operated to its 'ON' position in a state in which no motor speed values V0, V1 have been input or stored, the control device 9 controls, after a sewing operation is finished, the stepper motor 8 such that the motor 8 is rotated at a predetermined speed value, e.g., speed V0. Thus, the needle thread is cut, the bobbin thread is drawn and cut, and the workpiece presser is elevated, while the motor 8 is rotated at the predetermined speed.

Next, there will be described the advantages of the holing sewing machine M constructed as described above.

First, the sewing machine M includes the stepper motor 8 which commonly but timing-differently operates the workpiece-presser elevating and lowering mechanism 5, the needle-thread cutting mechanism 6, and the bobbin-thread drawing and cutting mechanism 7; and the control device 9 which allows the user to input the motor speed V1 to be used when the needle thread is cut, such that the input speed V1 is higher than the motor speed V0 to be used when the bobbin thread is drawn from the bobbin, and which actually rotates the stepper motor 8 such that the motor speed V1 is higher than the motor speed V0. Thus, the present sewing machine M can reduce the time duration needed to cut the needle thread before the bobbin thread is drawn from the bobbin.

Second, the control device 9 allows the user to input the motor speed V1 to be used when the workpiece presser 37 is elevated, such that the input speed V1 is higher than the motor speed V0 to be used when the bobbin thread is drawn from the bobbin, and which actually rotates the stepper motor 8 such that the motor speed V1 is higher than the motor speed V0. Thus, the present sewing machine M can reduce the time duration needed to elevate the workpiece presser after the bobbin thread is drawn from the bobbin. Thus, the present sewing machine M can cut the needle and bobbin threads and elevate the workpiece presser, without braking the bobbin thread, in a very short cycle time, Tb, as compared with a conventional cycle time, Ta. That is, the present sewing machine M enjoys an improved operation or production efficiency.

Third, the present sewing machine M allows the user to input the speed V1 of the stepper motor 8 when the needle thread is cut and when the workpiece presser 37 is elevated, and the speed V0 of the motor 8 when the bobbin thread is drawn from the bobbin, independent of each other. Therefore, depending upon the sort of a new bobbin thread, for example, the user can input another motor speed V0' lower than the current motor speed V0, without keeping the motor speed V1 unchanged. In this case, a cycle time Tb' is much shorter than the conventional cycle time Ta. Thus, the sewing machine M enjoys an improved production efficiency.

With the cheap stepper motor 8 and the simple cam mechanism 21, the present sewing machine M can shorten the cycle time needed to perform the needle-thread and bobbin-thread cutting operations and the presser elevating operation, without braking the bobbin thread when the bobbin thread is drawn from the bobbin. Thus, the sewing machine M can be produced at reduced cost.

While the present invention has been described in its preferred embodiment, the present invention may be otherwise embodied.

Figure 7:
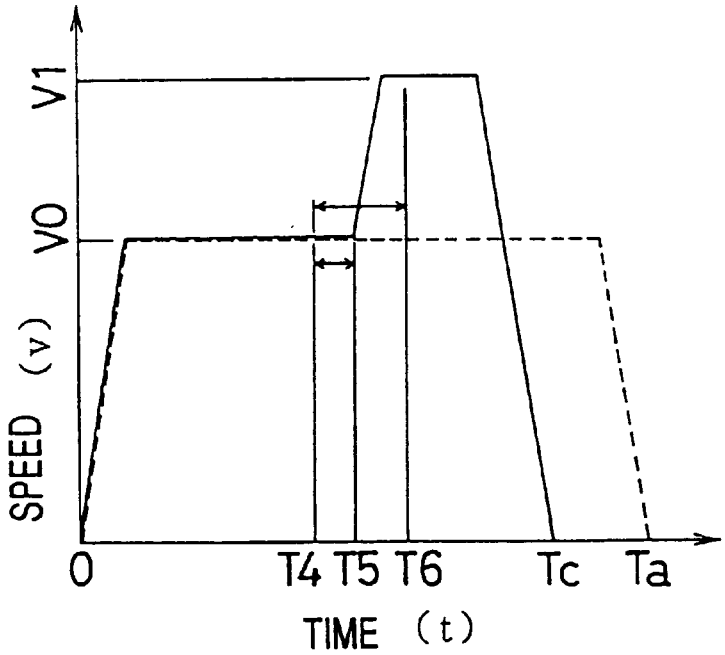
FIG. 7 is a graph showing a time-wise change of a speed of another stepper motor of another holing sewing machine as a second embodiment of the present invention.

For example, the control device 9 may be modified to control the stepper motor 8 such that the speed of the motor 8 is increased up to the input and stored speed V0 in a time duration between the start time and a fourth time, T4, as shown in FIG. 7, and the needle-thread cutting mechanism 6 cuts the needle thread while the motor 8 is rotated at the low speed V0. The bobbin-thread drawing and cutting mechanism 7 cuts the bobbin thread in a time period between the fourth time T4 and a sixth time, T6. More specifically described, the control device 9 controls the stepper motor 8 such that the speed of the motor 8 is maintained at the low speed V0 during a time period between the fourth time T4 and a fifth time, T5, and the bobbin-thread drawing and cutting mechanism 7 draws the bobbin thread from the bobbin while the motor 8 is rotated at the low speed V0. The movable and fixed blades 52, 55 cooperate with each other to cut the bobbin thread immediately after the bobbin-thread-draw member 53 draws a certain length of the bobbin thread from the bobbin. Subsequently, the control device 9 controls the stepper motor 8 such that the speed of the motor 8 is increased up to the input and stored speed V1 in a time period between the fifth time T5 and the sixth time T6, and the workpiece-presser elevating and lowering mechanism 5 elevates the workpiece presser 37 in a time period between the sixth time T6 and an end time, Tc. That is, the workpiece presser 37 is elevated while the motor 8 is rotated at the high speed V1. Thus, the speed of the stepper motor 8 is controlled such that the motor speed V0 when the needle thread is cut is equal to the motor speed V0 when the bobbin thread is drawn from the bobbin and such that the motor speed V1 when the workpiece presser 37 is elevated is higher than the motor speed V0 when the bobbin thread is drawn from the bobbin. Thus, the present modified sewing machine M can cut the needle and bobbin threads and elevate the workpiece presser, without braking the bobbin thread, in a short cycle time, Tc, as compared with the conventional cycle time, Ta. That is, this modified sewing machine M enjoys an improved operation or production efficiency.

Figure 8:
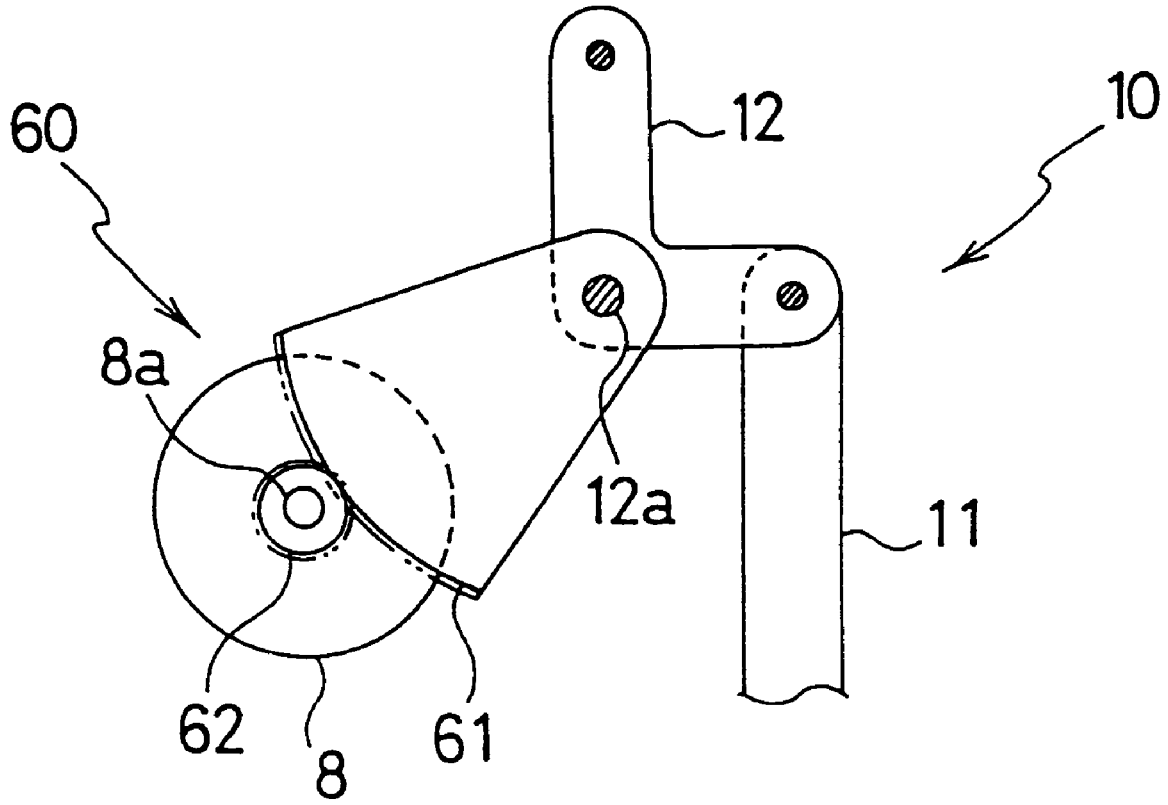
FIG. 8 is a side elevation view of a gear mechanism of another holing sewing machine as a third embodiment of the present invention.
Figure 9:
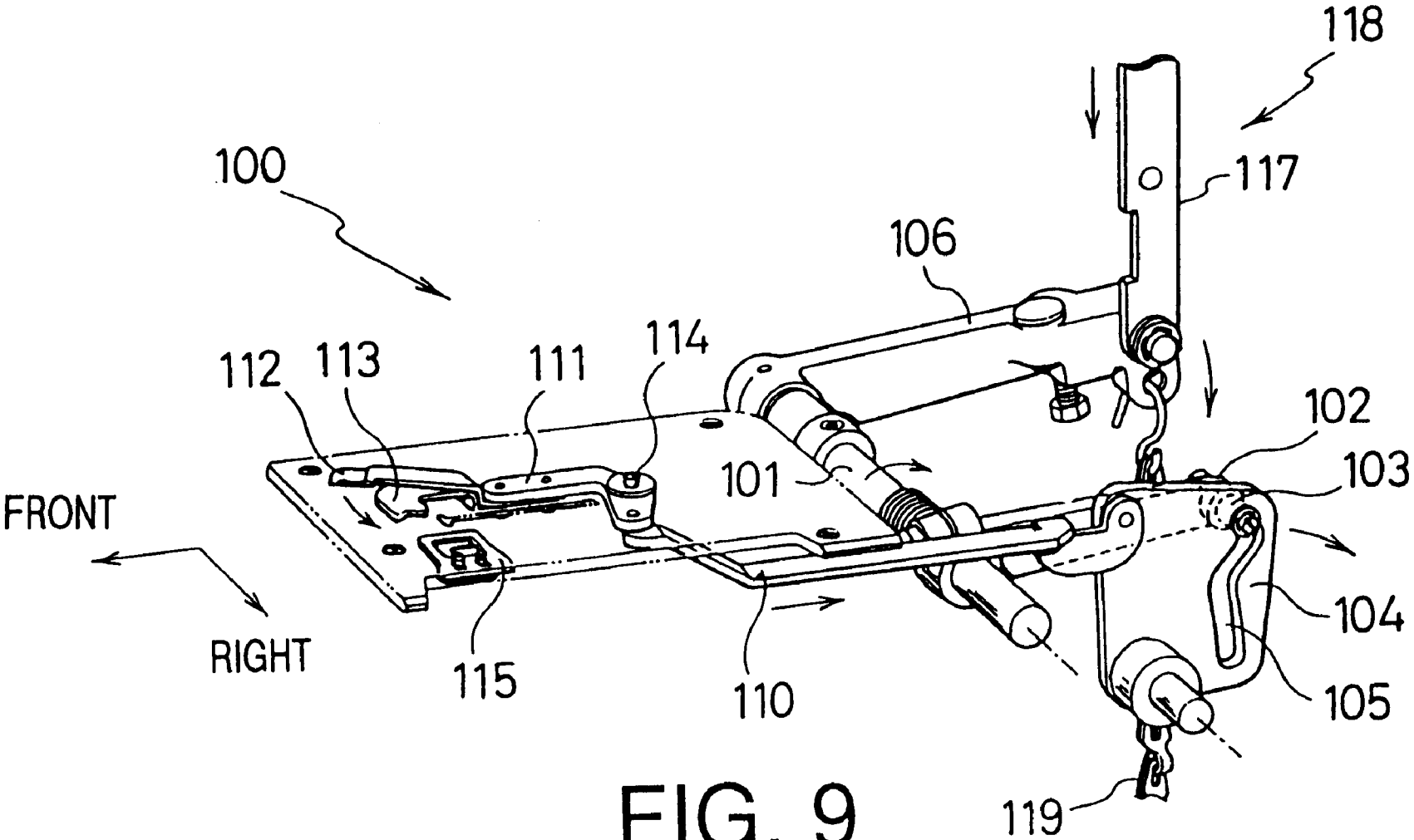
FIG. 9 PRIOR ART
FIG. 9 is a perspective view of a conventional bobbin-thread cutting mechanism.

Meanwhile, the cam mechanism 21 and the drive link 20 of the interlocking and connecting mechanism 10 employed in the holing sewing machine M may be replaced with a gear mechanism 60 shown in FIG. 8. The gear mechanism 60 transmits the driving force of the stepper motor 8 to the workpiece-presser elevating and lowering mechanism 5, the needle-thread cutting mechanism 6, and the bobbin-thread cutting mechanism 7. The gear mechanism 60 directly drives or pivots the first L-shaped link 12 of the interlocking and connecting mechanism 10 and, to this end, includes a sector gear 61 which is fixed to the axis member 12*a* of the first L-shaped link 12; and a drive gear 62 which is fixed to the output shaft 8*a* of the stepper motor 8 and which is meshed with the sector gear 61. The gear mechanism 60 enjoys a simple construction and transmits, with reliability, the driving force of the stepper motor 8 to the above-indicated three mechanisms 5, 6, 7. Thus, the gear mechanism 60 contributes to reducing tire cycle time of cutting the needle and bobbin threads and elevating the workpiece presser, without braking the bobbin thread when the bobbin thread is drawn from the bobbin, and also contributes to reducing the production cost of the holing sewing machine M as a whole.

The stepper motor 8 may be replaced with another sort of actuator such as a solenoid-operated actuator or an air-pressure-operated cylinder device. In this case, the control device 9 may be modified to control the speed of operation of the actuator such that the operation speed of the actuator is changed to each of a plurality of appropriate speed values, e.g., the above-described speed values V0, V1.

In the illustrated embodiment, the cutting of the bobbin thread occurs after the cutting of the needle thread. However, the holing sewing machine M may be modified such that the cutting of the bobbin thread occurs before, or concurrently with, the cutting of the needle thread. In either case, the control device 9 may be modified to control the stepper motor 8 such that the motor 8 is rotated at the low speed V0 during a first duration in which the bobbin thread is drawn from the bobbin, and is rotated at the high speed V1 during a second time duration, other than the first time duration in a full cycle time, in which the needle thread may be cut and the workpiece presser is elevated.

Figure 6:
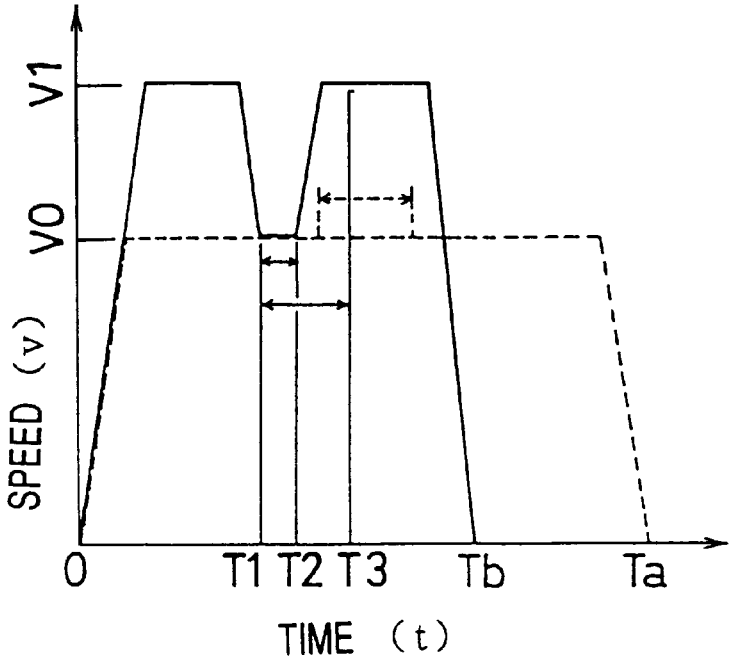
FIG. 6 is a graph showing a time-wise change of a speed of a stepper motor of the holing sewing machine of FIG. 1.

In the embodiment shown in FIG. 6, the user can change, as needed, each of the motor speed V0 when the bobbin thread is drawn from the bobbin and tie motor speed V1 when the needle thread is cut and when the workpiece presser is elevated. In addition, in the embodiment shown in FIG. 7, the user can change, as needed, the motor speed V0 when the needle thread is cut.

The principle of the present invention is applicable to not only the illustrated sort of holing sewing machine M but also other sorts of holing sewing machines or systems.

It is to be understood that the present invention may be embodied with other changes, improvements, and modifications that may occur to those skilled in the art without departing from the scope and spirit of the invention defined in the appended claims.

What is claimed is:

1. A holing sewing machine comprising:

a workpiece-presser elevating and lowering mechanism which elevates and lowers a workpiece presser which presses at least one workpiece;

a needle-thread cutting mechanism which cuts a needle thread conveyed by a sewing needle;

a bobbin-thread cutting mechanism which draws a bobbin thread from a bobbin and cuts the bobbin thread;

an interlocking mechanism which mechanically interlocks the workpiece-presser elevating and lowering mechanism, the needle-thread cutting mechanism, and the bobbin-thread cutting mechanism, with one another, such that the elevating and lowering mechanism elevates the workpiece presser after the needle-thread cutting mechanism cuts the needle thread and the bobbin-thread cutting mechanism cuts the bobbin thread;

a drive source which is connected to the interlocking mechanism and which drives the interlocking mechanism to operate the workpiece-presser elevating and lowering mechanism, the needle-thread cutting mechanism, and the bobbin-thread cutting mechanism, the drive source being controllable with respect to a speed of operation thereof to drive the interlocking mechanism; and a control device which is connected to the drive source and which controls the drive source such that the drive source is operated at a higher speed at at least one of a time when the needle-thread cutting mechanism cuts the needle thread and a time when the elevating and lowering mechanism elevates the workpiece presser, than a speed at a time when the bobbin-thread cutting mechanism draws the bobbin thread from the bobbin.

2. A holing sewing machine according to claim 1, further comprising a cam mechanism which transmits a driving force of the drive source via the interlocking mechanism to the workpiece-presser elevating and lowering mechanism, the needle-thread cutting mechanism, and the bobbin-thread cutting mechanism.

3. A holing sewing machine according to claim 1, further comprising a gear mechanism which transmits a driving force of the drive source via the interlocking mechanism to the workpiece-presser elevating and lowering mechanism, the needle-thread cutting mechanism, and the bobbin-thread cutting mechanism.

4. A holing sewing machine according to claim 1, wherein the drive source comprises an electric motor selected from the group consisting of a stepper motor and a servomotor.

5. A holing sewing machine according to claim 1, wherein the drive source comprises an electric motor selected from the group consisting of a rotary motor and a linear motor.

6. A holing sewing machine comprising:

a workpiece-presser elevating and lowering mechanism which elevates and lowers a workpiece presser which presses at least one workpiece;

a needle-thread cutting mechanism which cuts a needle thread conveyed by a sewing needle;

a bobbin-thread cutting mechanism which draws a bobbin thread from a bobbin and cuts the bobbin thread;

an interlocking mechanism which mechanically interlocks the workpiece-presser elevating and lowering mechanism, the needle-thread cutting mechanism, and the bobbin-thread cutting mechanism, with one another;

a stepper motor which drives the interlocking mechanism to operate the workpiece-presser elevating and lowering mechanism, the needle-thread cutting mechanism, and the bobbin-thread cutting mechanism; and a control device which controls the stepper motor such that the stepper motor is operated at a changeable speed.

7. A holing sewing machine according to claim 6, wherein the interlocking mechanism interlocks the workpiece-presser elevating and lowering mechanism, the needle-thread cutting mechanism, and the bobbin-thread cutting mechanism, with one another, such that the elevating and lowering mechanism elevates the workpiece presser after the needle-thread cutting mechanism cuts the needle thread and the bobbin-thread cutting mechanism cuts the bobbin thread, and wherein the control device controls the stepper motor such that the stepper motor is operated at a higher speed at at least one of a time when the needle-thread cutting mechanism cuts the needle thread and a time when the elevating and lowering mechanism elevates the workpiece presser, than a speed at a time when the bobbin-thread cutting mechanism draws the bobbin from the bobbin.

8. A holing sewing machine according to claim 6, further comprising a cam mechanism which transmits a driving force of the stepper motor via the interlocking mechanism to the workpiece-presser elevating and lowering mechanism, the needle-thread cutting mechanism, and the bobbin-thread cutting mechanism.

9. A holing sewing machine according to claim 6, further comprising a gear mechanism which transmits a driving force of the stepper motor via the interlocking mechanism to the workpiece-presser elevating and lowering mechanism, the needle-thread cutting mechanism, and the bobbin-thread cutting mechanism.

10. A holing sewing machine comprising:

a workpiece-presser elevating and lowering mechanism which elevates and lowers a workpiece presser which presses at least one workpiece;

a needle-thread cutting mechanism which cuts a needle thread conveyed by a sewing needle;

a bobbin-thread cutting mechanism which draws a bobbin thread from a bobbin and cuts the bobbin thread;

an interlocking mechanism which mechanically interlocks the workpiece-presser elevating and lowering mechanism, the needle-thread cutting mechanism, and the bobbin-thread cutting mechanism, with one another;

a drive source which is connected to the interlocking mechanism and which drives the interlocking mechanism to operate the workpiece-presser elevating and lowering mechanism, the needle-thread cutting mechanism, and the bobbin-thread cutting mechanism, the drive source being controllable with respect to a speed of operation thereof to drive the interlocking mechanism;

a speed-data obtaining device which obtains a first set of speed data and a second set of speed data, independent of each other, the first set of speed data being indicative of a first speed of the drive source at at least one of a time when the needle-thread cutting mechanism cuts the needle thread and a time when the elevating and lowering mechanism elevates the workpiece presser, the second set of speed data being indicative of a second speed of the drive source at a time when the bobbin-thread cutting mechanism draws the bobbin from the bobbin; and a control device which is connected to the speed-data obtaining device and the drive source and which controls, based on each of the first and second sets of speed data obtained by the speed-data obtaining device, the drive source such that the drive source is operated at a corresponding one of the first and second speeds indicated by the first and second sets of speed data.

11. A holing sewing machine according to claim 10, wherein the interlocking mechanism interlocks the workpiece-presser elevating and lowering mechanism, the needle-thread cutting mechanism, and the bobbin-thread cutting mechanism, with one another, such that the elevating and lowering mechanism elevates the workpiece presser after the needle-thread cutting mechanism cuts the needle thread and the bobbin-thread cutting mechanism cuts the bobbin thread, and wherein the control device controls the drive source such that the drive source is operated at said at least one of the time when the needle-thread cutting mechanism cuts the needle thread and the time when the elevating and lowering mechanism elevates the workpiece presser, at the first speed higher than the second speed at which the drive source is operated at the time when the bobbin-thread cutting mechanism draws the bobbin from the bobbin.

12. A holing sewing machine according to claim 10, wherein the speed-data obtaining device comprises an input device which is connected to the control device and which is operable by a user for inputting at least one of the first and second sets of speed data.

13. A holing sewing machine according to claim 10, further comprising a memory in which at least one of the first and second sets of speed data is stored, wherein the speed-data obtaining device reads said at least one set of speed data from the memory.

* * * * *